US006860746B2

(12) United States Patent
Ota et al.

(10) Patent No.: US 6,860,746 B2
(45) Date of Patent: Mar. 1, 2005

(54) ARC DISCHARGE SUPPRESSIVE TERMINAL PAIR

(75) Inventors: Kouji Ota, Nagoya (JP); Hiroki Hirai, Nagoya (JP); Yoshitsugu Tsuji, Nagoya (JP); Satoshi Takano, Osaka (JP); Masahiro Shibata, Osaka (JP); Atsushi Kimura, Osaka (JP); Masahiko Kanda, Osaka (JP); Narito Yagi, Osaka (JP); Noriki Hayashi, Osaka (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/372,128

(22) Filed: Feb. 25, 2003

(65) Prior Publication Data

US 2003/0176093 A1 Sep. 18, 2003

(30) Foreign Application Priority Data

Feb. 26, 2002 (JP) ..... 2002-049697
Aug. 8, 2002 (JP) ..... 2002-231300

(51) Int. Cl.[7] ..... H01R 13/53

(52) U.S. Cl. ..... 439/181; 439/886

(58) Field of Search ..... 439/181, 886, 439/891, 887

(56) References Cited

U.S. PATENT DOCUMENTS

| | | | | |
|---|---|---|---|---|
| 4,747,783 A | | 5/1988 | Bellamy et al. | |
| 4,752,334 A | | 6/1988 | Nadkarni et al. | |
| 4,999,336 A | | 3/1991 | Nadkarni et al. | |
| 5,139,891 A | * | 8/1992 | Cowie et al. | 439/886 |
| 5,208,978 A | * | 5/1993 | Dixon et al. | 439/886 |
| 5,236,789 A | | 8/1993 | Cowie et al. | |
| 2001/0024895 A1 | | 9/2001 | Sakiyama et al. | |
| 2002/0064986 A1 | * | 5/2002 | Hirai et al. | 439/181 |

* cited by examiner

*Primary Examiner*—Tho D. Ta
*Assistant Examiner*—Felix O. Figueroa
(74) *Attorney, Agent, or Firm*—Oliff & Berridge, PLC

(57) ABSTRACT

Provided is a pair of arc discharge suppressive terminals electrically communicable with each other by engagement of the terminal pair. At least one of the terminal pair has a final contact site which is in contact with the counterpart terminal at a final stage of disengagement of the terminal pair. At least the final contact site is covered with an arc discharge suppressive layer containing a first metal having a melting point of 1,550° C. or higher. It is preferable that the terminal pair contact with each other at a portion corresponding to a main contact site other than the arc discharge suppressive layer in a completely engaged state where the one of the terminal pair and the counterpart terminal are tightly engaged with each other. Preferably, the main contact site has a surface made of a material having a higher conductivity than the arc discharge suppressive layer. This arrangement effectively suppresses occurrence of arc discharge at a time of disengagement of the terminal pair.

14 Claims, 10 Drawing Sheets

ARC DISCHARGE SUPPRESSIVE TERMINAL PAIR

BACKGROUND OF THE INVENTION

1. Field of the Invention

This invention relates to a terminal pair for use in electrical connection in an automobile or the like.

2. Description of the Related Art

It is a general practice to detach connectors used in automobiles or the like from each other every several months or every several years for maintenance and checkup. It is high likely that arc discharge may occur at a detachment of terminals of the connectors from each other. Particularly, it is conceivable that a considerably large amount of arc is discharged in view of the recent development of technology in which a high source voltage is supplied for a battery of an automobile. Therefore, it is highly likely that the terminals may be damaged due to occurrence of such large arc discharge.

Generally, a male terminal has a bar-like or a plate-like shape with a lead end thereof tapered in order to facilitate its insertion into a female terminal. Every time the male terminal is disengaged from and engaged with the female terminal, arc discharge occurs. The repeated engagement and disengagement causes to melt the tapered lead end of the male terminal due to repeated arc discharges. The melted part of the male terminal is cooled to solidify, accompanied by shifting of the melted part slightly toward a base end thereof. As a result of the melting, the tapered lead end of the male terminal disappears, which accompanies increase of a diameter of the lead end of the male terminal. In other words, the male terminal is likely to be deformed due to melting by repeated arc discharges, which may result in contact failure with the female terminal or, in a worse case, difficulty or inability of its insertion into the female terminal.

SUMMARY OF THE INVENTION

It is an object of this invention to provide a pair of terminals which is free from the problems residing in the prior art.

It is another object of this invention to provide a pair of terminals that enables to effectively suppress occurrence of arc discharge at the time of detachment or disengagement of the terminals and to suppress deformation and damage of the terminals due to occurrence of arc discharge.

According to an aspect of this invention, a pair of arc discharge suppressive terminals electrically communicable with each other by engagement of the terminal pair has a feature that at least one of the terminal pair has a final contact site which is in contact with the counterpart terminal at a final stage of disengagement of the terminal pair, and that at least the final contact site is covered with a plating layer (arc discharge suppressive layer) containing a first metal (high-melting metal) having a melting point of 1,550° C. or higher.

In the above arrangement, since the final contact portion is covered with the arc discharge suppressive layer containing the high-melting metal, effectively suppressed is occurrence of arc discharge at the time of disengagement of the terminal pair, thereby preventing deformation and damage of the terminal pair due to occurrence of arc discharge.

These and other objects, features and advantages of the present invention will become more apparent upon a reading of the following detailed description and accompanying drawing.

DESCRIPTION OF THE PREFERRED EMBODIMENTS

There has been proposed a technique of covering a site (e.g. a lead end of a male terminal) where arc discharge may likely to occur with an insulating layer in order to suppress occurrence of arc discharge. However, even if the lead end of the male terminal is covered with the insulating layer, arc discharge cannot be completely suppressed for the following reason. For instance, a male terminal and a female terminal are electrically connected with each other at a base end portion (main contact portion) of the male terminal in a state that the male terminal and the female terminal are tightly engaged with each other (namely, in a completely engaged state). When the male terminal is about to be detached or disengaged from the female terminal from the completely engaged state, the site of the male terminal in contact with the female terminal is shifted from the main contact portion (base end portion) of the male terminal to the lead end of the male terminal covered with the insulating layer. Arc discharge may occur during the shifting. Thus, the arrangement in which the insulating layer covers merely the lead end of the male terminal fails to suppress arc discharge.

Considering the drawback residing in the above conventional arrangement, demanded is a technique as to how to suppress arc discharge while maintaining conductivity of the terminals in an arrangement to suppress arc discharge at a site (final contact site) on one of a terminal pair which is in contact with the other terminal at a final stage of detachment. In view of the above demand, the inventors of the invention have found out, as a result of extensive research and development in an attempt to solve the above drawbacks residing in the prior art, that covering the final contact site of the terminal with a plating layer (hereinafter, sometimes referred to as "arc discharge suppressive layer") containing a metal having a high-melting point of 1,550° C. or higher enables to secure conductivity of the terminals and at the same time to remarkably suppress arc discharge to thereby suppress deformation of the terminals because the plating layer (arc discharge suppressive layer) contains the metal having the high-melting point, and accomplished this invention.

Hereinafter, preferred embodiments of this invention are described in detail with reference to the accompanying drawings.

Figure 1A:
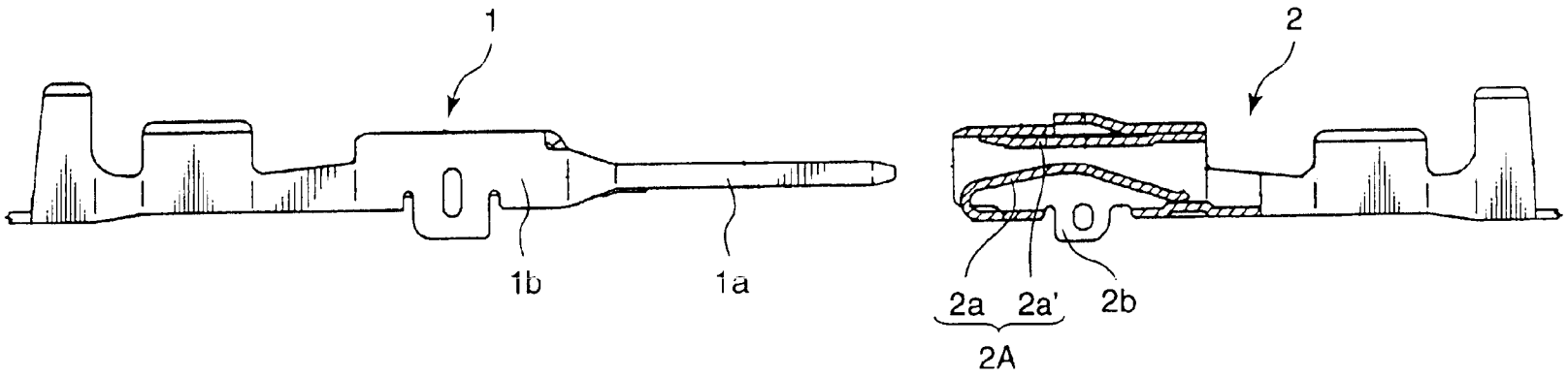
FIGS. 1A and 1B are partially cut-away side views each showing a pair of terminals in accordance with an embodiment of this invention, with connectors.
Figure 1B:
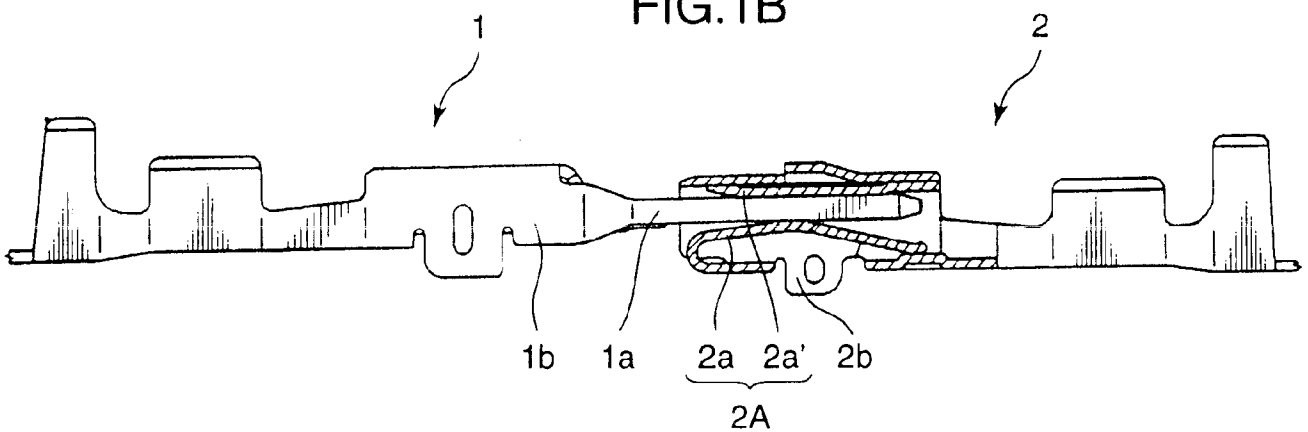
Figure 2:
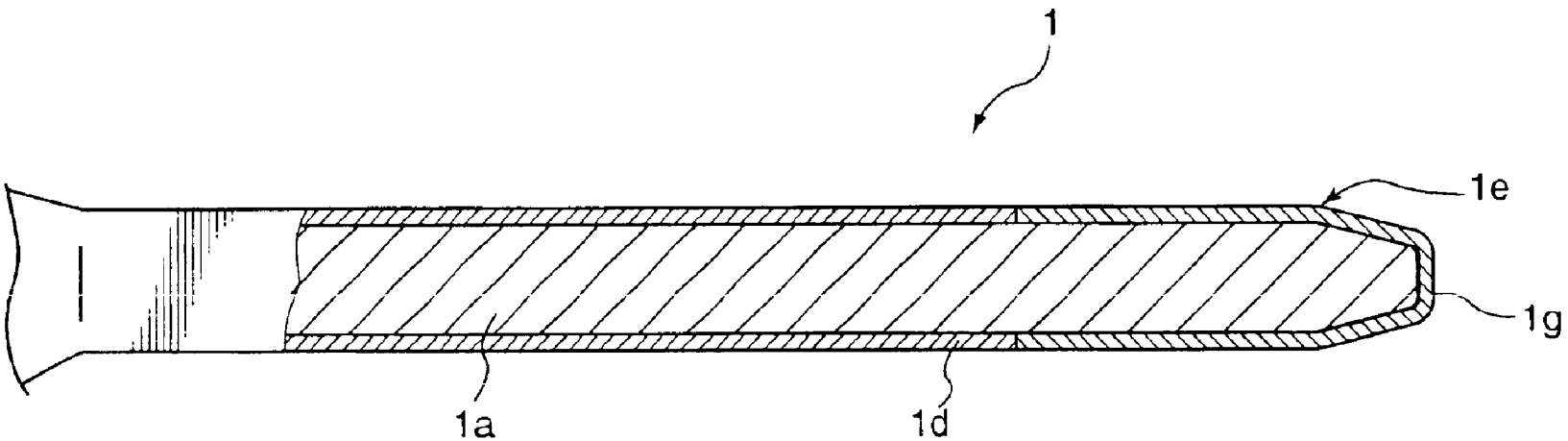
FIG. 2 is a partially enlarged sectional view of the male terminal shown in FIGS. 1A and 1B.
Figure 3:
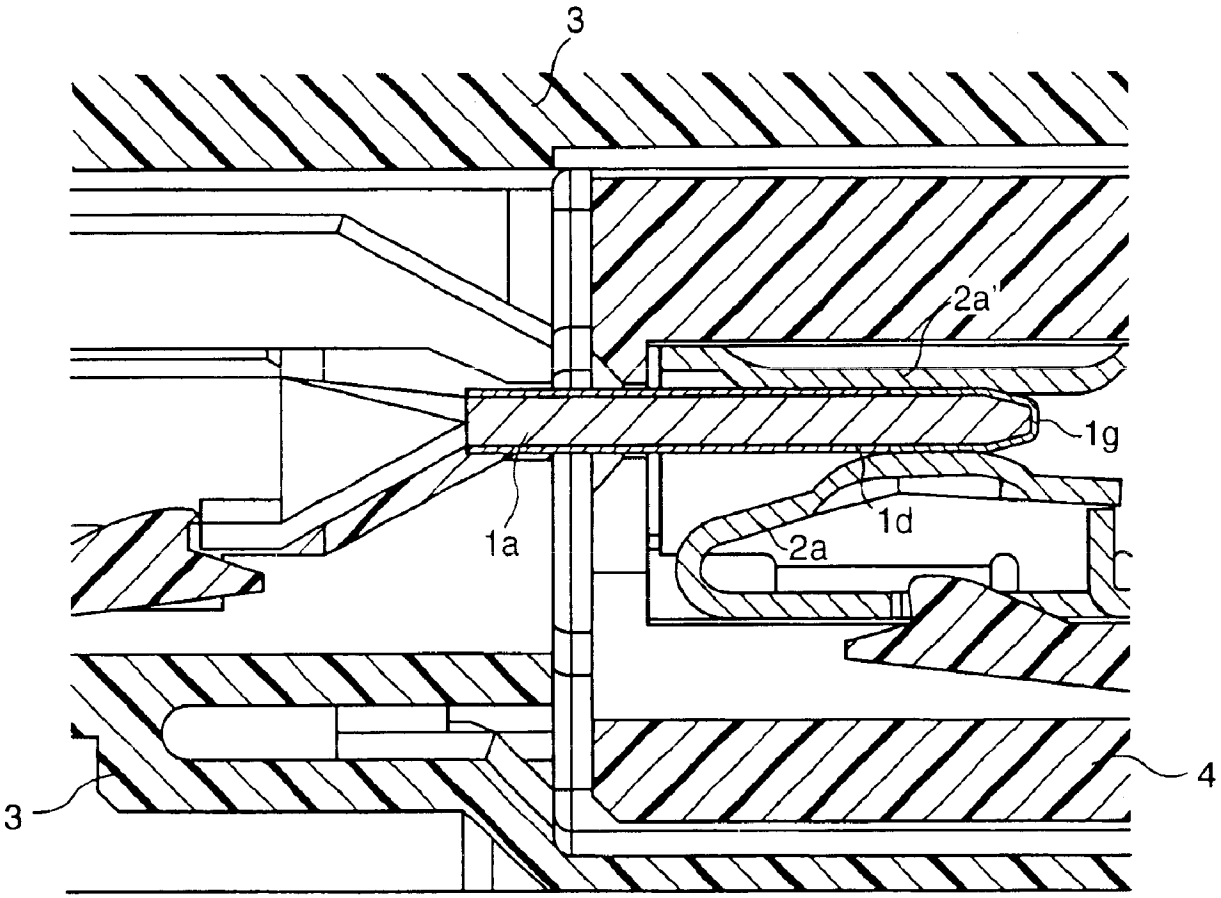
FIG. 3 is a partially enlarged sectional view showing a state that the male terminal and the female shown in FIGS. 1A and 1B are engaged with each other.
Figure 4:
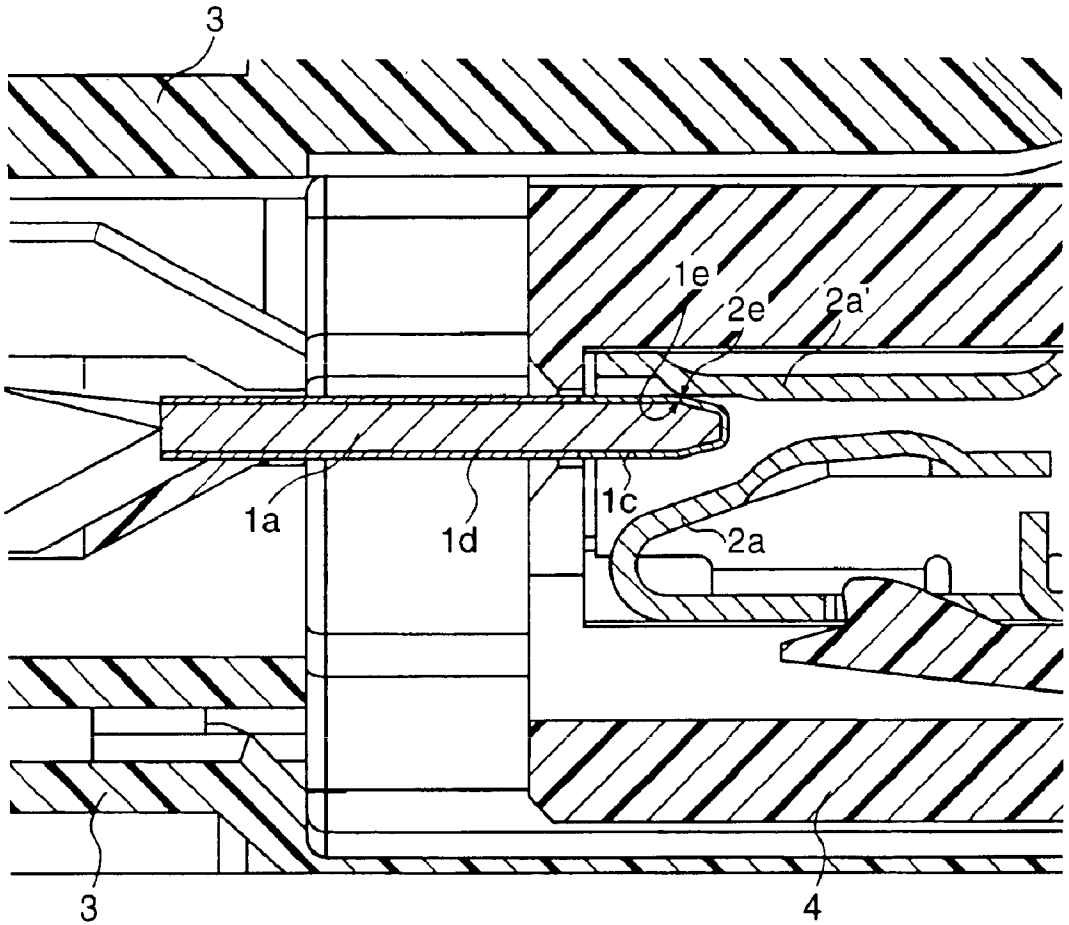
FIG. 4 is a partially enlarged sectional view showing a state that the male terminal shown in FIGS. 1A and 1B is about to be disengaged from the female terminal.

FIGS. 1A and 1B are partially cut-away side views respectively showing a state that a male terminal as an embodiment of this invention and a female terminal are about to be engaged with each other and a state that the male terminal and the female terminal are engaged with each other. FIG. 2 is a partially enlarged sectional view showing the inventive male terminal. FIG. 3 is a partially enlarged sectional view showing a state that the inventive male terminal and the female terminal are engaged with each other. FIG. 4 is an enlarged sectional view showing a state that the inventive male terminal is about to be disengaged from the female terminal.

As shown in FIG. 1A, the male terminal 1 includes a box-shaped portion 1*b* constituting a terminal main body, and a male-type electric contact portion (male tab) 1*a* which extends in a forward direction of the male terminal 1 from the box-shaped portion 1*b*. The main body of the male terminal 1 is made of a material having a high conductivity such as copper. The male terminal 1 and a resinous housing 3 (see FIG. 3) for housing the male terminal 1 constitute a male connector. The female terminal 2 includes a box-shaped portion 2*b*. A contact spring piece 2*a* and a second contact piece 2*a*' which is opposed to the contact spring piece 2*a* are formed inside the box-shaped portion 2*b* at such a position as to tightly hold the male tab 1*a* therebetween. Similar to the male terminal 1, the female terminal 2 and a resinous housing 4 (see FIG. 3) for housing the female terminal 2 constitute a female connector. As shown in FIGS. 1B and 3, the male tab 1*a* is rendered into contact with a female-type electric contact portion 2A comprised of the contact spring piece 2*a* and the second contact piece 2*a*' when the male terminal 1 is engaged with the female terminal 2. When the male tab 1*a* contacts the electric contact portion 2A, the terminals 1 and 2 are electrically communicable with each other.

When the male terminal 1 is about to be disengaged from the female terminal 2, there is a possibility that arc discharge may occur between the male tab 1*a* and the electric contact portion 2A. For instance, referring to FIG. 4, when the male terminal 1 is about to be detached from the female terminal 2 in the backward direction (leftward direction in FIG. 4), the male tab 1*a* is detached from the contact spring piece 2*a*, and then from the second contact piece 2*a*'. When the male terminal 1 is about to be completely detached from the female terminal 2 at a final stage of detachment or disengagement, namely when the male tab 1*a* is disengaged from the second contact piece 2*a*' in FIG. 4, arc discharge may occur between the male terminal 1 and the female terminal 2, which may cause damage of the terminals 1, 2.

In view of the above, according to the embodiment of this invention, a predetermined region including a final contact site 1*e* of the male tab 1*a* of the male terminal 1 which is detached from the female terminal 2 at a final stage of detachment or disengagement is covered with a plating layer (arc discharge suppressive layer) 1*c* containing a metal having a high melting point Hereinafter, the predetermined region is sometimes referred to as "arc discharge suppressive site". Specifically, in the embodiment of this invention, the lead end portion of the male terminal 1 corresponding to the final contact site 1*e* of the male tab 1*a* is covered with the arc discharge suppressive layer 1*c* (in the embodiment, Ni—W plating layer) containing tungsten as a metal having a high melting point. It should be noted that the remaining part of the male tab 1*a* other than the arc discharge suppressive site (in this embodiment, corresponding to the base end portion of the male tab 1*a*) is covered with a general purpose plating layer 1*d* (in the embodiment, Sn plating layer) which is used for conventional terminals. Hereinafter, the remaining part of the male tab 1*a* other than the arc discharge suppressive site is sometimes referred to as "main contact site".

When the final contact site 1*e* (and arc discharge suppressive site) of the male tab 1*a* is covered with the arc discharge suppressive layer 1*c*, as shown in FIG. 4, occurrence of arc discharge can be securely suppressed at the time of detachment of the terminals 1 and 2, thereby suppressing deformation of the terminals 1 and 2. Specifically, in the conventional terminals on which the arc discharge suppressive layer is not formed, large arc discharge accompanied by glaring light may occur in disengagement of the conventional terminals, with the result that deformation of the terminals may occur. According to the embodiment of this invention, by using the terminal where the arc discharge suppressive layer is formed, occurrence of large arc discharge accompanied by glaring light can be suppressed, thereby suppressing deformation of the terminals. It is conceived that insignificant arc discharge may occur even in the arrangement of the embodiment of this invention because small spark sounds have been heard in disengagement or detachment of the inventive terminals.

Figure 5:
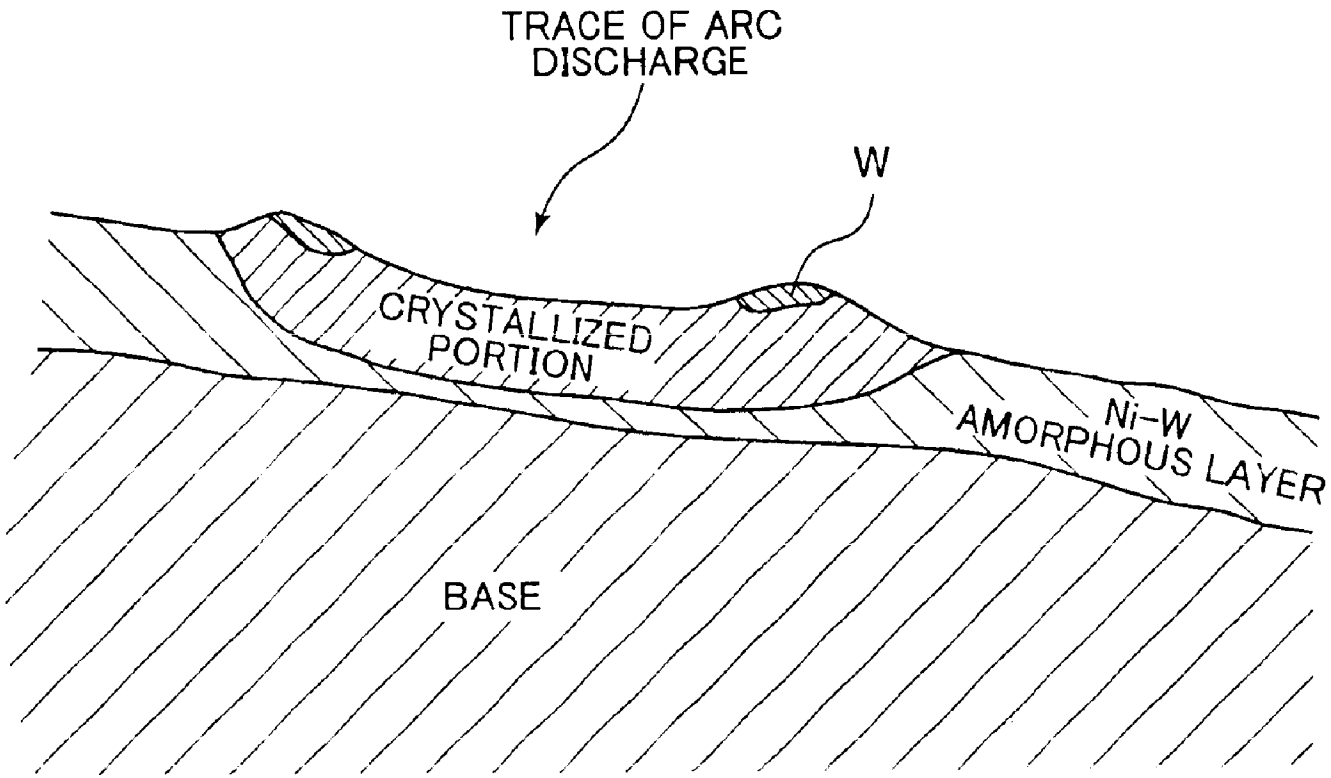
FIG. 5 is a sectional view illustrating trace of arc discharge.

The inventors of this invention observed the site where such a small arc discharge occurred through an electronic microscope to elucidate a reason why the inventive terminal pair can suppress occurrence of arc discharge. A result of observation on a trace of small arc discharge is shown in FIG. 5 which is a schematic sectional view. As is obvious from FIG. 5, the base layer of the male tab 1*a* is covered with an Ni—W plating layer (arc discharge suppressive layer) in amorphous state with a crater-like insignificant trace of arc discharge being formed in the surface of the Ni—W plating layer. The crater-like portion includes an outer annular rib where condensed tungsten exists, and the remaining portion composed of crystallized structure. It is conceived that the crystallized portion is formed as a result of temporary melting of the amorphous Ni—W plating layer which follows cooling.

An analysis on the reason why arc discharge is suppressed in the inventive terminal pair is as follows. Namely, although the Ni—W amorphous layer is temporarily melted due to occurrence of arc discharge, tungsten having a higher melting point than nickel is condensed around the outer periphery of the Ni—W amorphous layer. As a result of the condensation, emission of metallic vapor is suppressed, thereby suppressing spread of the arc discharge.

Furthermore, since the arc discharge suppressive layer 1*c* contains a metal, the arc discharge suppressive layer 1*c* has conductivity. The fact that the arc discharge suppressive layer 1*c* has conductivity is important in suppressing arc discharge. Let it be assumed that the final contact site of the male tab is covered with an insulating member. Then, when the terminal pair is shifted from a completely engaged state as shown in FIG. 3 where the portion of the male tab covered with the general-purpose plating layer (in this embodiment, Sn plating layer) is electrically communicated with the female-type electric contact portion 2A to a state where the male terminal is detached from the female terminal, the site of the male terminal in contact with the electric contact portion 2A is shifted from the site covered with the general-purpose plating layer 1*d* to the final contact site covered with the insulating member. Then, it is highly likely that arc discharge may occur during the shifting, thus failing to suppress occurrence of arc discharge. In view of the above, it is essential to provide the arc discharge suppressive layer 1*c* with conductivity that is sufficient to suppress occurrence of arc discharge. According to the embodiment of this invention, since the arc discharge suppressive layer 1*c* is a metallic plating layer, the aforementioned conductivity is secured.

The arc discharge suppressive site is not specifically limited as far as the arc discharge suppressive site includes the final contact site 1*e*. However, it is desirable that the arc discharge suppressive site includes at least the following region, in addition to the final contact site 1*e:* a region having an axial length of 1 mm or less adjoining the final contact site 1*e;* preferably, a region having an axial length of 3 mm or less adjoining the final contact site 1*e*; and furthermore preferably, a region having an axial length of 5 mm or less adjoining the final contact site 1*e*.

Covering the above region with the arc discharge suppressive layer 1*c*, in addition to the final contact site 1*e* enables to securely prevent likelihood that arc discharge is directly transmitted to the male terminal 1 while avoiding the arc discharge suppressive layer 1*c*.

In the case of the male terminal 1, it is often the case that a tongue end 1*g* or its vicinity (in the example of FIGS. 2 and 4, the site 1*e*) corresponds to the final contact site. In view of this, it is preferable to set a region having an axial length of not smaller than 1 mm, preferably not smaller than 3 mm toward the base end of the male terminal 1 from an edge of the tongue end 1*g*, as the arc discharge suppressive site, and to cover the arc discharge suppressive site with the arc discharge suppressive layer 1*c*.

With respect to a metal of a high-melting point (hereinafter, referred to as "high-melting metal") composing the arc discharge suppressive layer 1*c*, the melting point of the high-melting metal is not lower than 1,550° C., preferably not lower than 1,600° C., furthermore preferably not lower than 1,700° C., and particularly preferably not lower than 2,500° C. Examples of such a metal include molybdenum, platinum, and iridium, in addition to tungsten. The melting point of the high-melting metal is generally 4,000° C. or lower. These high-melting metals are used alone or in combination of at least two kinds thereof.

Preferable examples of the high-melting metal include tungsten, molybdenum, platinum, and iridium (particularly, tungsten, platinum, and iridium). Among these, platinum and iridium can be used alone as a plating material. However, it is difficult to use tungsten and molybdenum alone as a plating material. In view of this, in case of adopting tungsten or molybdenum as a high-melting metal, it is preferable to use the metal in combination with a metal having plating-layer formability (hereinafter, the metal having plating-layer formability is sometimes referred to as "plating metal") and to perform plating by utilizing the plating-layer formability of the plating metal It is desirable to use a metal having a melting point of not lower than 1,000° C. and lower than 1,550° C. as the plating metal. The metal having a melting point of not lower than 1,000° C. and lower than 1,550° C. is advantageous in plating with a high-melting metal (such as tungsten and molybdenum) without lowering the arc discharge suppressive ability of these high-melting metals, compared with a case that a metal having a melting point of lower than 1,000° C. is used as the plating metal. Examples of the metal having a melting point of not lower than 1,000° C. and lower than 1,550° C. include a metal which is classified into Group VIII of the periodic table of the elements such as iron, cobalt, and nickel. The plating metals are used alone or in combination of at least two kinds thereof.

The particularly preferable plating metal includes cobalt and nickel. Cobalt and nickel have excellent corrosion resistance in addition to the advantage in plating with the high-melting metal.

In case of using a metal having difficulty in plating such as tungsten and molybdenum for forming the arc discharge suppressive layer, the arc discharge suppressive layer may be a plating layer of an alloy which is obtained by mixing tungsten or molybdenum with the plating metal. Alternatively, the arc discharge suppressive layer may be a complex plating layer in which tungsten, molybdenum, or an alloy thereof is dispersed in matrices of the plating metal.

In case of using a high-melting metal such as tungsten and molybdenum which have difficulty in plating for forming the arc discharge suppressive layer, the larger the content of the high-melting metal in the arc discharge suppressive layer is, the more the arc discharge suppressive ability of the terminals is expected. The ratio of the content of the high-melting metal to the total content of the compositions of the arc discharge suppressive layer is e.g. not smaller than 5 mass %, preferably not smaller than 20 mass %, furthermore preferably not smaller than 30 mass %, and particularly preferably not smaller than 40 mass %. On the other hand, the upper limit of the content of the high-melting metal (sum of the contents of tungsten and molybdenum) in the arc discharge suppressive layer is not specifically limited as far as a plating layer is formable. However, the upper limit of the high-melting metal content is generally 70 mass %, preferably 60 mass %, and particularly preferably 50 mass %.

In case of adopting platinum or iridium as the high-melting metal, it is a general practice to compose the arc discharge suppressive layer solely of such a high-melting metal. However, it is possible to use other metal(s) in combination with such a high-melting metal as long as the use does not impair the effects of this invention.

Normally, the arc discharge suppressive layer is a single layer. However, it is possible to place other metallic layer(s) (plating layer or layers), onto or under the arc discharge suppressive layer as far as the formation of the additional plating layer(s) does not impair the effects of this invention. Further alternatively, it is possible to form the arc discharge suppressive layer into a multi layer. For instance, a layer composed of tungsten and/or molybdenum and a plating metal, and a layer composed of platinum and/or iridium may constitute the arc discharge suppressive layer.

The larger the thickness of the arc discharge suppressive layer is, the more the arc discharge suppressive effect is obtainable. The thinness of the arc discharge suppressive layer can be optimally set depending on a potential difference right after the final stage of disengagement of terminals and a quantity of electric current flow through the terminals. The thickness of the arc discharge suppressive layer is 3 $\mu$m or larger, preferably 5 $\mu$m or larger, and further preferably 10 $\mu$m or larger. Even if the thickness of the arc discharge suppressive layer is set exceedingly large, no further arc discharge suppressive effect is expected when the thickness exceeds a certain value. The thickness of the arc discharge suppressive layer is generally 30 $\mu$m or smaller, preferably 20 $\mu$m or smaller, and further preferably 15 $\mu$m or smaller.

According to the embodiment of this invention, the manner of forming the arc discharge suppressive layer is not specifically limited. A known plating method such as electrolytic plating and electroless plating) is usable to form the arc discharge suppressive layer. Electroless plating layer is more effective than electrolytic plating layer in suppressing arc discharge.

When the male terminal 1 and the female terminal 2 are in a completely engaged state, the male terminal 1 is in contact with the female terminal 2 at least at the main contact site other than the arc discharge suppressive site. For instance, as shown in FIG. 3, in the completely engaged state, the male tab 1*a* is in contact with the female terminal 2 not only at the lead end portion (arc discharge suppressive site) of the male tab 1*a* but also at the base end portion thereof. It is possible to cover the main contact site of the male tab 1*a* with the arc discharge suppressive layer (e.g. a plating layer containing at least one kind selected from the group consisting of tungsten, molybdenum, platinum, and iridium, as a high-melting metal). However, it is desirable to cover the main contact-site of the male tab 1*a* with a layer composed of a material having a higher conductivity than the arc discharge suppressive layer, or a material having a low contact resistance than the arc discharge suppressive layer. Conductive reliability of the terminals can be secured by enhancing conductivity of the main contact site of the male tab 1*a*.

Figure 8:
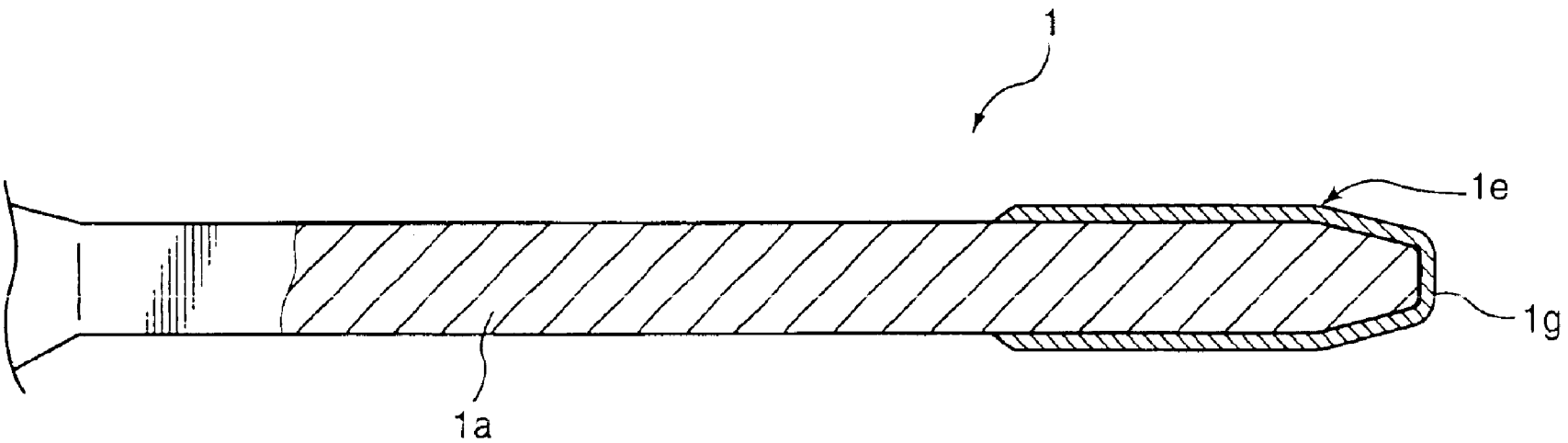
FIG. 8 is a partially enlarged sectional view of a modified male terminal.

In case of securing high conductive reliability, the surface of the main contact site of the male tab la may be covered with a general-purpose plating layer (conventional plating layer) or may be left uncovered to directly expose the base of the male terminal 1 which is made of e.g. copper as shown in FIG. 8. It is preferable to cover the surface of the main contact site with a general-purpose plating layer. Covering the main contact site with a general-purpose plating layer not only enables to prevent corrosion of the base layer but also enables to enhance conductive reliability of the terminals because the surface of the general-purpose plating layer is relatively soft, which contributes to increase of the contact area of the main contact portion in contact with the counterpart terminal (female terminal).

Examples of the general-purpose plating layer include a known plating layer used for a terminal, e.g., a plating layer made of gold, copper, tin, silver, nickel or cobalt. In case of using nickel as a high-melting metal, it is often the case that a layer other than a nickel-plating layer is used as the general-purpose plating layer.

As shown in FIGS. 2, 3, and 4, the arc discharge suppressive layer 1*c* which is formed at the arc discharge suppressive site and the general-purpose plating layer 1*d* which is formed at the main contact site may be formed independently of each other in such a manner that the arc discharge suppressive layer 1*c* is not overlapped with the general-purpose plating layer 1*d*. Alternatively, the arc suppressive layer and the general-purpose plating layer may be overlapped with each other as long as the final contact site 1*e* is covered with the arc discharge suppressive layer 1*c*.

Specifically, the following covering methods are proposed:

i) one of the plating layers is laid over the other one of the plating layers in a boundary between the plating layers;

ii) one of the plating layers constitute a base layer, and the other one of the plating layers is partially laid over the base layer; and iii) the final contact site 1*e* and its vicinity are covered with the arc discharge suppressive layer 1*c*, and then, substantially the entirety of the male terminal 1 including the entirety of the arc discharge suppressive layer 1*c* is covered with a general-purpose plating layer.

Figure 9:
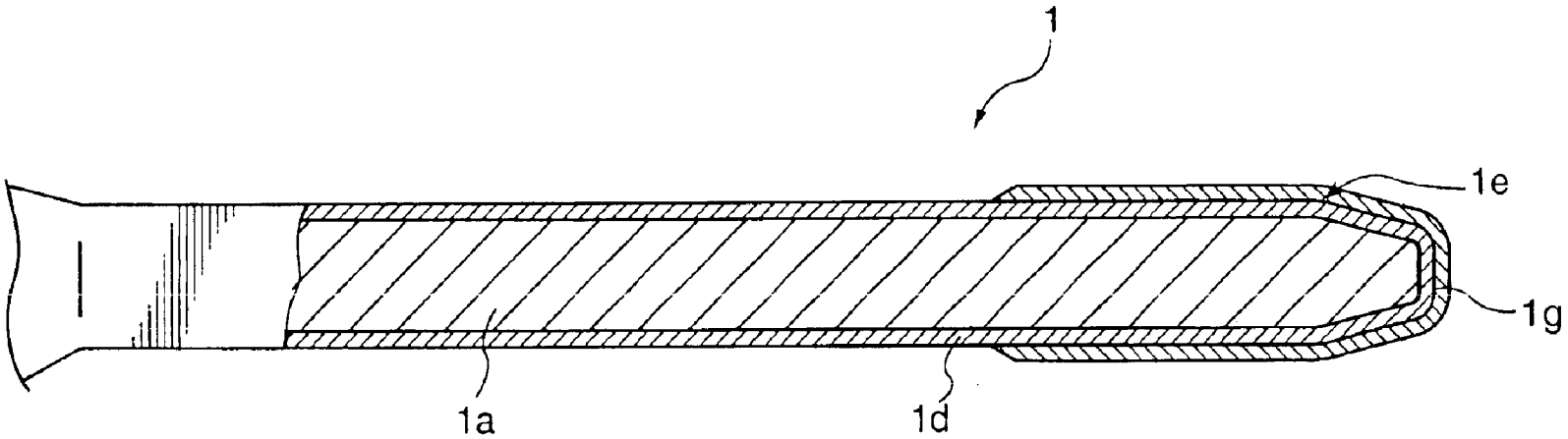
FIG. 9 is a partially enlarged sectional view of another modification of the male terminal.

In the method ii), the general-purpose plating layer may constitute a base layer, and the arc discharge suppressive layer may partially be laid over the base. layer in such a manner that the arc discharge suppressive layer covers the final contact site 1*e* as shown in FIG. 9. Alternatively, the arc discharge suppressive layer may constitute a base layer, and the general-purpose plating layer may partially be laid over the base layer (arc discharge suppressive layer) except the final contact site 1*e*.

The configuration of the male tab 1*a* is not specifically limited. The male tab 1*a* can take a variety of forms such as plate-like, bar-like, or cylindrical shape.

It is possible to form the base of the male terminal 1 from a single piece made of a single material. In this case, as shown in FIGS. 1A, 1B, and 2, it is possible to cover the lead end portion of the male tab 1*a* of the male terminal 1 with the arc discharge suppressive layer 1*c*, and to cover the base end portion thereof with the general-purpose plating layer 1*d*. For instance, a plurality of kinds of platings are applicable to the male terminal 1 by, for example, partially immersing the male terminal 1 in a plating solution (e.g. by immersing merely the lead end portion of the male tab 1*a* in a plating solution) or by a masking.

Alternatively, assembling two (or more) parts into the male terminal 1 makes it possible to form the arc discharge suppressive layer 1*c* and the general-purpose plating layer 1*d* in a simplified manner. For instance, the male terminal 1 can be produced in a simplified manner by preparing a lead end part on which the arc discharge suppressive layer 1*c* is formed, and a base end part on which a conductive plating layer is formed individually, and by assembling these parts together.

Figure 6:
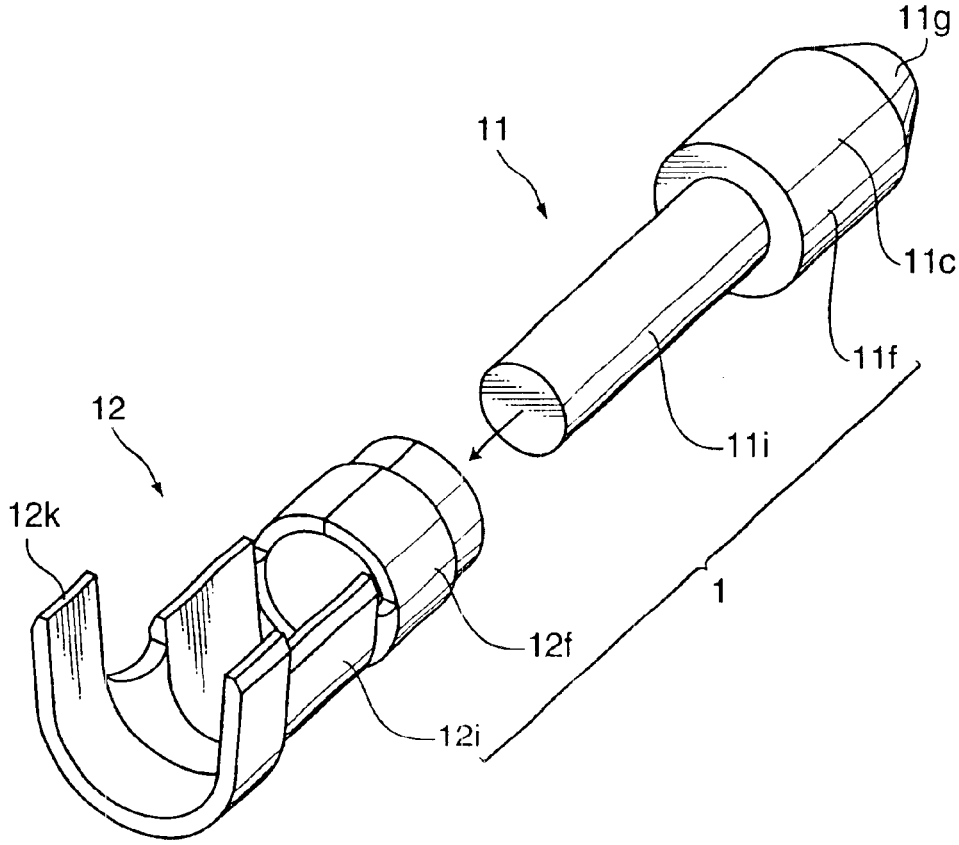
FIG. 6 is a exploded perspective view showing a modification of the inventive male terminal.
Figure 7:
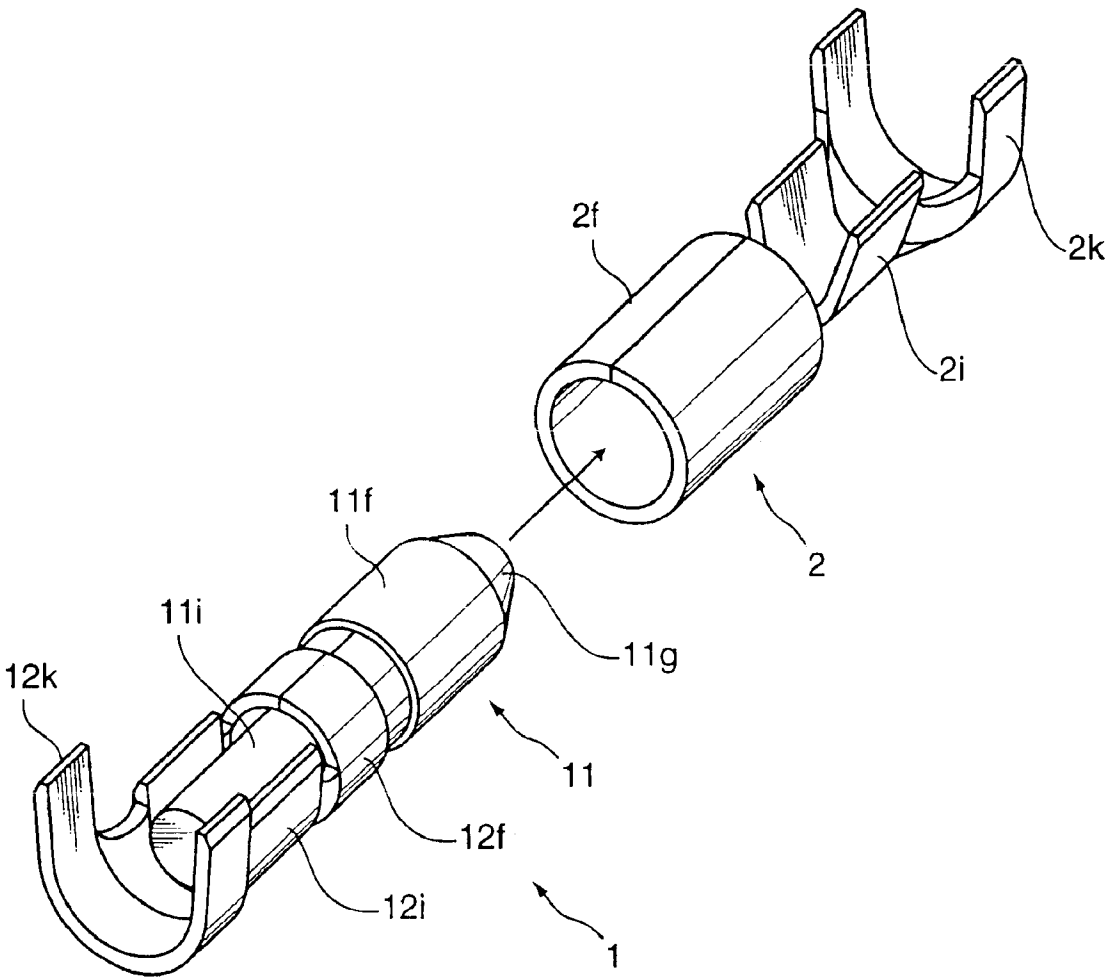
FIG. 7 is a perspective view showing a state that the modified male terminal shown in FIG. 6 is about to be engaged with a female terminal.

Next, described is a modification of the embodiment of this invention with reference to FIGS. 6 and 7.

FIG. 6 is a perspective view showing a state that a lead end part 11 and a body part 12 are being assembled into the male terminal 1. FIG. 7 is a perspective view showing a state that the male terminal 1 in an assemble state is being engaged with the female terminal 2. The lead end part 11 constituting the male terminal 1 includes a cylindrical electric contact portion 11*f* covered with an arc discharge suppressive layer 11*c*, and a small-diametrical coupling shaft 11*i* extending rearward of the male terminal 1 from the electric contact portion 11*f*. The electric contact portion 11*f* and the coupling shaft 11*i* are integrally formed with each other. A tip end 11*g* of the electric contact portion 11*f* has a tapered shape (truncated conical shape).

The main body part 12 includes a cylindrical electric contact portion 12*f* which corresponds to the main contact portion of the male terminal 1, a coupling-shaft holding portion 12*i* in the form of a barrel for tightly holding the coupling shaft 11*i*, and an electric-wire holding portion 12*k* in the form of a barrel for tightly holding an electric wire. Specifically, the inner diameter of the main contact portion 12*f* has such a size as to receive the coupling shaft 11*i* of the lead end part 11. With this arrangement, the lead end part 11 and the main body part 12 are assembled into the terminal by passing the coupling shaft 11*i* of the lead end part 11 through the cylindrical electric contact portion 12*f* from a front side of the male terminal 1 (in a direction shown by the arrow in FIG. 6), and by tightly holding the coupling shaft 11*i* in the coupling-shaft holding portion 12*i* which is located behind the electric contact portion 12*f*. The outer diameter of the main contact portion 12*f* is substantially the same as the outer diameter of the electric contact portion 11*f* of the lead end part 11. With this arrangement, after assembling the lead end part 11 and the main body part 12 into the male terminal 1, the male terminal 1 is engaged with the female terminal 2 with the electric contact portion 11*f* of the lead end part 11 and the electric contact portion 12*f* of the main body part 12 constituting an electric contact unit.

Referring to FIG. 7, the female terminal 2 includes a cylindrical electric contact portion 2*f* for fittingly receiving the electric contact portions 11*f* and 12*f* of the male terminal 1 substantially without a clearance, a conductive-wire holding portion 2*i* which is in the form of a barrel and is located behind the electric contact portion 2*f* for holding a conductive wire, and an insulating-layer holding portion 2*b* in the form of a barrel for tightly holding an insulating layer of a conductive wire.

In the above arrangement of the modification, a similar arc discharge suppressive effect as in the embodiment can be obtained by covering the electric contact portion 11*f* of the lead end part 11 with an arc discharge suppressive layer. It is possible to cover the electric contact portion (main contact portion 12*f* of the main body part 12 with an arc discharge suppressive layer in a similar manner as in the above embodiment. However, it is preferable to expose the base of the electric contact portion 12*f* without performing plating or to cover the electric contact portion 12*f* with a general-purpose plating layer.

The lead end part 11 and the main body part 12 are assembled together into the terminal by various known methods such as engagement and caulking.

Figure 10:
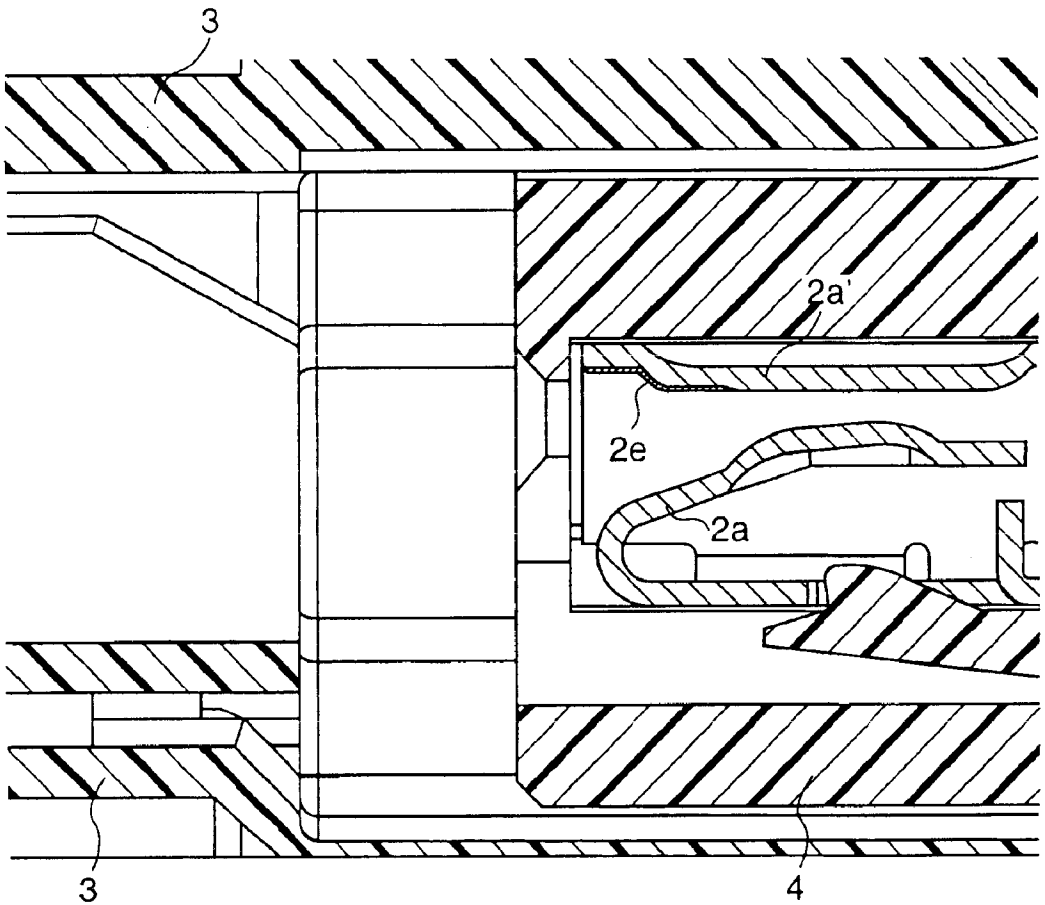
FIG. 10 is a cross sectional view showing a female connector with an arc discharge suppressive layer.

The arc discharge suppressive layer may be formed on the female terminal in place of the male terminal as shown in FIG. 10. Alternatively, the arc discharge suppressive layer may be formed both on the male terminal and the female terminal. The arc discharge suppressive layer may be formed on the female terminal in a similar manner as the arc discharge suppressive layer is formed on the male terminal. Specifically, the site of forming the arc discharge suppressive layer (arc discharge suppressive site) is not specifically limited as long as the arc discharge suppressive site includes a final contact site of the female terminal. For instance, in the case where the arc discharge suppressive layer is formed on the female terminal in the examples of FIGS. 1A through 4, the arc discharge suppressive layer is formed on a region including a final contact site 2*e* (arc discharge suppressive site) which is in contact with the male terminal 1 at a final stage of detachment or disengagement. It may be possible to form the arc discharge suppressive layer on a main contact portion (e.g. the surface of the contact spring piece 2*a*) of the female terminal 2 as well as the final contact site 2*e* in a similar manner as the arc discharge suppressive layer is formed on the male terminal. However, it is desirable not to form the arc discharge suppressive layer on the main contact portion of the female terminal 2. It is possible to expose a base metal at a site of the main contact portion of the female terminal 2 in a similar manner as in the arrangement of the male terminal. Alternatively, the main contact portion of the female terminal 2 may be covered with a general-purpose plating layer.

The inventive male (and/or female) terminal is covered with the arc discharge suppressive layer at the final contact site (arc discharge suppressive site) thereof. In this arrangement, even if arc discharge occurs, occurrence of the arc discharge is immediately suppressed with the result that the terminal pair itself is free from damage. Even if a high voltage (e.g. about 36V) is applied between the terminal pair and a large electric current flows (e.g. current of about 10 A), the male terminal is allowed to be engaged with and disengaged from the female terminal a plurality of number of times (e.g. thrice or more, preferably five times or more, furthermore preferably ten times or more) without occurrence of large arc discharge accompanied by glaring light. Using the inventive terminal pair in a wire harness of an automobile is advantageous in suppressing occurrence of large arc discharge in detachment or disengagement of the terminals at the time of maintenance and checkup despite the fact that a high voltage is applied to the terminal pair. The inventive terminal pair may be applicable to a field where a low voltage (or low electric current) is applied. Namely, the inventive terminal pair may be used in a field where a low voltage is applied in order to secure a safety system, consider a possibility that a high voltage may be applied to the system due to occurrence of an operation failure or the like.

EXAMPLES

Hereinafter, this invention is described by means of the following examples. It should be noted that the invention is not limited by the examples and that any modification and alteration of this invention which does not depart from the spirit of essential characteristics of the aforementioned and below-mentioned description are construed to be embraced in the technical range of this invention.

Examples 1 through 7

Respective sets of the male tab 1*a* and the female-type electric contact portion 2A shown in FIGS. 1A through 4 were applied with a corresponding plating as shown in Table 1. In each example, the male tab 1*a* was tightly received in the female-type electric contact portion 2A until the male terminal 1 and the female terminal 2 were brought to a completely engaged state as shown in FIG. 3. Thereafter, the male terminal 1 was detached from the female terminal 2. The engagement and disengagement (detachment) were repeated a certain number of times while applying a voltage of 36V (current of 10A at the time of engagement) until a large arc discharge accompanied by glaring light occurred. Counted was the number of times during which the engagement and disengagement could carried on without causing large arc discharge.

The results of the experiment are shown in Table 1.

TABLE 1

| | Kind of Plating | | | | |
|---|---|---|---|---|---|
| | Male tab 1a | | Female-type contact portion 2A | | |
| Ex No. | Lead end portion (region having 5 mm-width from a lead end) | Base end portion (main contact portion) | Second contact piece 2a' | spring piece 2a (main contact portion) | Number of times of disengagement |
| 1 | Ni—$W_{46}$ e.p. (thickness: 10 μm) | Sn | Ni—$W_{46}$ e.p. (thickness: 10 μm) | Sn | 5 times |
| 2 | Co e.p. (thickness: 10 μm) | electrolytic | Ni—$W_9$ e.l.p. (thickness: 10 μm) | electrolylic | 8 times |
| 3 | Co—$W_{46}$ e.p. (thickness: 10 μm) | plating | Co—$W_{46}$ e.p. (thickness: 10 μm) | plating | 10 times or more |
| 4 | Ni—$W_9$ e.l.p. (thickness: 10 μm) | (thickness: | Ni e.p. (thickness: 10 μm) | (thickness: | 7 times |
| 5 | Ni—$W_9$ e.l.p. (thickness: 10 μm) | 1 μm) | Ni—$W_9$ e.l.p. (thickness: 10 μm) | 1 μm) | 10 times or more |
| 6 | Sn e.p. (thickness: 1 μm) | | Sn e.p. (thickness: 1 μm) | | 0 time |
| 7 | Co e.p. (thickness: 10 μm) | | Co e.p. (thickness: 10 μm) | | One time |

Note:
e.p. denotes electrolytic plating, and. e.l.p. denotes electroless plating.

It should be noted that in Table 1, Ni—$W_9$ electroless plating layer, Ni—$W_{46}$ electrolytic plating layer, and Co—$W_{46}$ electrolytic plating layer are alloy plating layers, respectively.

As is obvious from Table 1, in the case where the final contact site (lead end portion of the male tab 1*a*, and the second contact piece 2*a*' of the female-type contact portion 2A) were plated with tin or cobalt, large arc discharge accompanied by glaring light occurred after disengagement of the terminals once or twice (see Example Nos. 6 and 7). On the other hand, when the lead end portion of the male tab 1*a* and/or the second contact piece 2*a*' of the female-type contact portion 2A were or was covered with the are discharge suppressive layer, engagement and disengagement of the terminals were successfully repeated five times or more without causing large arc discharge accompanied by glaring light (see Example Nos. 1 through 5). Particularly, as is obvious from comparison between Example No. 7 and Example Nos. 2 & 3, the number of times of disengagement remarkably increased by adding a high-melting metal (tungsten) in the plating layer.

To summarize this invention, according to an aspect of this invention, a pair of arc discharge suppressive terminals electrically communicable with each other by engagement of the terminal pair has a feature that at least one of the terminal pair has a final contact site which is in contact with the counterpart terminal at a final stage of disengagement of the terminal pair, and that at least the final contact site is covered with a plating layer (arc discharge suppressive layer) containing a first metal (high-melting metal) having a melting point of 1,550° C. or higher.

Preferably, the terminal pair contact with each other at a portion corresponding to a main contact site other than the arc discharge suppressive layer in a completely engaged state where the one of the terminal pair and the counterpart terminal are tightly engaged with each other, and the main contact site has a surface made of a material having a higher conductivity than the arc discharge suppressive layer, or a material having a lower contact resistance than the arc suppressive layer. This arrangement provides improved conductive reliability.

Preferably, the high-melting metal includes tungsten, molybdenum, platinum and iridium (particularly preferably, tungsten, platinum, and iridium). In case of using tungsten or molybdenum as the high-melting metal, the following matter should be noted. Specifically, since tungsten and molybdenum do not have plating-layer formability, it is necessary to perform plating with tungsten or molybdenum in combined use with a metal (plating metal) having plating-layer formability. It is recommendable to use a metal such as iron, cobalt, and nickel, as the plating metal because these metals have second-best arc discharge suppressive ability to the high-melting metal.

Preferably, the sum of the contents of tungsten and molybdenum ranges 5 to 70 mass % with respect to the total content of the compositions of the arc discharge suppressive layer.

It is preferable to set the thickness of the arc discharge suppressive layer at 3 μm or larger. The larger the content of the high-melting metal is, or the larger the thickness of the arc discharge suppressive layer is, the more the arc discharge suppressive ability is obtainable.

This application is based on Japanese patent application No. 2002-49697 and No. 2002-231300 filed on Feb. 26, 2002 and Aug. 8, 2002 respectively, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A connector including a male connector and a female connector which are to be disengageably engaged with each other for electric communication therebetween, wherein the female connector includes a female contact portion, and the male connector includes a main body made of a material having conductivity, and an arc discharge suppressive layer plated on a lead end portion of the main body including a portion to be disengaged from the female connector at a final stage of disengaging process, the main body having a conducting portion which is to be brought into contact with the female contact portion for the electric communication and has a higher conductivity than the arc discharge suppressive layer, wherein the main body of the male connector is partially exposed to form the conducting portion.

2. A connector according to claim 1, wherein the conducting portion is plated by a conductive layer having a higher conductivity than the arc discharge suppressive layer.

3. A connector according to claim 2, wherein the conductive layer is formed by a material of at least one of gold, copper, tin, silver, nickel and cobalt.

4. A connector according to claim 2, wherein the conductive layer is formed on an entire surface of the main body and the arc discharge suppressive layer is formed on a part of the conductive layer.

5. A connector according to claim 1, wherein the arc discharge suppressive layer is formed by a metal material having a high melting point and conductivity, and including at least one of tungsten, molybdenum, platinum and iridium.

6. A connector according to claim 1, wherein the arc discharge suppressive layer is formed by a combination of a first material having a high melting point, and a second material having a low melting point and plating property.

7. A connector according to claim 6, wherein the first material is selected from the group consisting of tungsten, molybdenum, platinum and iridium, and the second material is selected from the group consisting of iron, cobalt and nickel.

8. A connector according to claim 1, wherein the arc discharge suppressive layer has a thickness of at least 3 $\mu$m.

9. A connector according to claim 8, wherein the arc discharge suppressive layer has a thickness less than 30 $\mu$m.

10. A connector according to claim 1, wherein the arc discharge suppressive layer is plated on the lead end portion of the main body to have an axial length from a tongue end of the main body toward a base end of the main body of not smaller than 1 mm.

11. A connector according to claim 1, wherein the arc discharge suppressive layer is plated on the lead end portion of the main body to have an axial length from a tongue end of the main body toward a base end of the main body of not smaller than 5 mm.

12. A connector including a male connector and a female connector which are to be disengageably engaged with each other for electric communication therebetween, wherein the female connector includes a female contact portion, and the male member includes a main body made of a material having conductivity, the main body having a conducting portion which is to be brought into contact with the female contact portion and an arc discharge suppressive layer plated on one of the female and male connectors at a portion where the male connector and the female connector are to be disengaged from each other at a final stage of disengaging process, the arc discharge suppressive layer being made of a metallic material having a high melting point and electric conductivity, wherein the conducting portion of the main body has higher conductivity than the arc discharge suppressive layer, wherein the main body of the male connector is at least partially exposed to form the conducting portion or the female contact portion is at least partially exposed.

13. A connector according to claim 12, wherein the arc discharge suppressive layer is formed by a combination of a first material having a high melting point, and a second material having a low melting point and plating property.

14. A connector according to claim 12, wherein the arc discharge suppressive layer is formed by a combination of molybdenum and at least one of iron, cobalt and nickel.

* * * * *